United States Patent [19]

Meratti

[11] 4,041,883

[45] Aug. 16, 1977

[54] PROCESS AND PLANT FOR THE MANUFACTURE OF SEWN BOOKS

[76] Inventor: Gianattilio Meratti, Torre de' Roveri (Bergamo), Italy

[21] Appl. No.: 703,986

[22] Filed: July 9, 1976

[30] Foreign Application Priority Data

July 9, 1975 Italy ..... 68784/75

[51] Int. Cl.[2] ..... B42B 1/02

[52] U.S. Cl. ..... 112/21; 11/1 A; 112/262; 156/253; 156/92; 156/513; 156/559; 270/37; 270/53

[58] Field of Search ..... 112/21, 22, 262; 227/80; 11/1 A; 270/37, 53; 156/253, 252, 92, 513, 559

[56] References Cited

U.S. PATENT DOCUMENTS

| | | | |
|---|---|---|---|
| 1,071,630 | 8/1913 | Allen et al. | 112/21 |
| 3,124,818 | 3/1964 | Byland | 11/1 A |
| 3,576,690 | 4/1971 | Staats et al. | 11/1 A X |
| 3,763,799 | 10/1973 | Bottcher | 112/21 |
| 3,855,039 | 12/1974 | Boettcher | 112/21 X |
| 3,915,445 | 10/1975 | Duncan et al. | 270/37 |

FOREIGN PATENT DOCUMENTS

| | | | |
|---|---|---|---|
| 1,284,126 | 8/1972 | United Kingdom | 112/21 |

*Primary Examiner*—H. Hampton Hunter
*Attorney, Agent, or Firm*—Sughrue, Rothwell, Mion, Zinn and Macpeak

[57] ABSTRACT

To manufacture a sewn book from a plurality of signatures, a length of thermoplastic filament is inserted through holes in the spine of each signature so that part of the filament is on the inside and the ends of the filament extend out through the holes, and the exterior parts of the filaments of a plurality of such signatures are interconnected by welding, preferably by welding them to transverse thermoplastic members, in order to join these signatures together.

10 Claims, 12 Drawing Figures

PROCESS AND PLANT FOR THE MANUFACTURE OF SEWN BOOKS

BACKGROUND OF THE INVENTION

The present invention relates to a process and apparatus for manufacturing sewn books.

As is known, books are made of a plurality of signatures joined together, and can be divided into sewn books and what are termed "perfect bound" books, called "paper-backs" though they may have hard covers.

In order to obtain a sewn book, a book-binding operation is carried out. The signatures for each individual book are grouped together in the correct order on a gathering machine and the groups are delivered to thread sewers for sewing the individual signatures together.

At present, a gathering machine has an average rate of delivery of about 3,000 books per hour, in theory almost independent of the number of signatures in the book.

In turn, a sewer, even if it is fed automatically by a feeder, cannot sew more than 5,000 signatures per hour, giving, for an average book of 20 signatures, a rate of production of 5,000 + 20 = 250 books per hour.

Thus to deal with the output of one gathering machine, one requires 3,000 + 250 = 12 automatic sewers controlled by a corresponding number of operators. In addition, there is no continuity of operation between the one gathering machine and the sewers which are necessary to cope with the output of the gathering machine. The groups of signatures formed by the gathering machine must be stored before passing them to the sewers in a second phase.

As a result, space and equipment must be provided for storing the groups of signatures delivered by the gathering machine, and manual operations and equipment are required for delivering the groups to the sewers. This causes a notable increase in production costs.

For forming perfect bound books, the signatures are gathered on a gathering machine, as in the case above, and the groups of signatures then pass directly, by way of a short conveyor, to a so-called "perfect" binder. The perfect binder has different work stations in which the back of each group of signatures is milled to ensure that the book is formed on a number of single sheets, and a layer of adhesive is applied to the back of the book to join the single sheets together. The perfect binder also carries out same further operations for finishing book.

A perfect binder works at substantially the same rate as the gathering machine, that is to say, 12 times as fast as a sewer.

The quality of the books manufactured by the two different methods is however very different. The quality of perfect bound books is low, and the difficulty in opening the book and the low strength of the join between the sheets in general limit the method of manufacture to low-price books which are read just once or only a few times. On the other hand, the quality of sewn books is high. Sewing, although expensive, is used for valuable books and for all books intended to be subjected to considerable use, for example school books, and the method is widely used.

OBJECT OF THE INVENTION

The object of the present invention is to provide a process and apparatus for manufacturing sewn books which allow one to make sewn books significantly more cheaply.

THE INVENTION

According to one aspect of the present invention, there is provided a process for the manufacture of sewn books from a plurality of signatures, comprising inserting through spaced holes in the spine of each signature a length of at least partly thermoplastic filament such that part of the filament extends between two holes on the inside of the signature and portions of the filament extend out through the holes to the exterior of the signature, and interconnecting the respective exterior parts of the filaments of a plurality of such signatures by welding in order to join the signatures together.

According to another aspect ot the present invention, there is provided apparatus for manufacturing sewn books from a plurality of signatures, the apparatus comprising: stitching means for forming spaced holes in the spine of each signature and for inserting through the holes a length of at least partly thermoplastic filament such that part of the filament extends between two such holes on the inside of the signature and portions of the filament extend out through the holes to the exterior of the signature; gathering means for placing the plurality of signatures adjacent one another; and welding means for interconnecting by welding the respective exterior parts of the filaments of the signatures in order to join the signatures together.

ADVANTAGES OF THE INVENTION

The use of separate lengths of filament for each signature and the subsequent welding step enable the book binding operation to be considerably speeded up and thus made less costly, and it is envisaged that the apparatus could be designed to operate at the same rate at a perfect binder. In addition, the apparatus can be used to bind books made up of signatures containing inserts.

An important subsidiary advantage of the invention is that one end porion of each length of filament can be welded to the other end portion thereof to form a closed loop for supporting the signature, facilitating subsequent conveying and gathering.

Other preferred features and advantages of the invention will appear from the description which follows, referring, by way of example, to one embodiment illustrated in the accompanying drawings.

DETAILED DESCRIPTION OF ONE EMBODIMENT OF THE INVENTION

Figure 1:
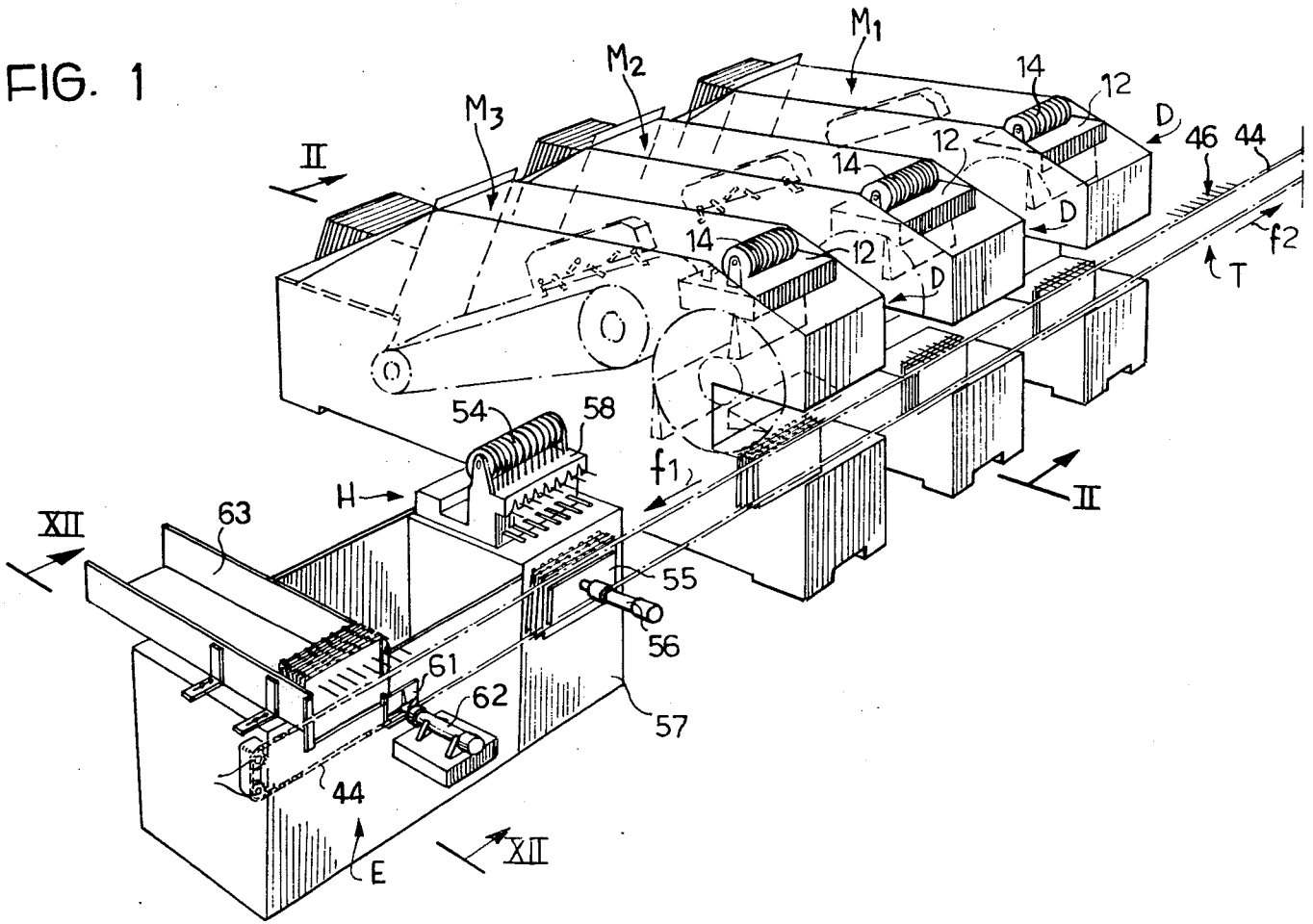
FIG. 1 is a perspective, schematic view of appparatus in accordance with the invention.

As shown in FIG. 1, the apparatus comprises a plurality of identical, aligned, side-by-side feeders, the last three of which, $M_1$, $M_2$ and $M_3$, are shown. The feeders are at equal intervals and their exits face a main conveyor T whose upper and lower runs follow straight paths indicated with the arrows $f_1$ and $f_2$, respectively. Identical intermediate transfer devices D are disposed between the exits of the feeders and the main conveyor R. The main conveyor T extends beyond the feeder $M_3$ and respective intermediate transfer device D, passes close to welding means H for joining the signatures together, and terminates just beyond discharging means E for ejecting the bound signatures.

Suitable feeders are well known, one being that described in British patent specification No. 1,234,720 and another being the Head-op feeder manufactured by Meccanotecnica S.p.A. of Bergamo, Italy. Each feeder (see FIG. 2) comprises a magazine 1 containing a stack of signatures 2 which are all the same, which are extracted one by one from the magazine, by known members (not shown) and deposited on the upper run of a continuous conveyor 3 with their spines trailing and transverse. The conveyor 3 has a chain provided with projections 4 and passing over end sprocket wheels 5 and 6, the upper run of the conveyor 3 moving in the direction of the arrow 7. A known type of opener 8 is disposed above the upper run of the conveyor 3, the opener 8 being provided with a plurality of oscillating or rotating suckers (not shown) and other members (not shown) which open the signatures at their middles. The signatures 2 are then deposited on a movable saddle S forming part of the intermediate transfer device D, which saddle comes adjacent the respective end of the conveyor 3 at the same time as the arrival of an already opened signature 2.

Figure 3:
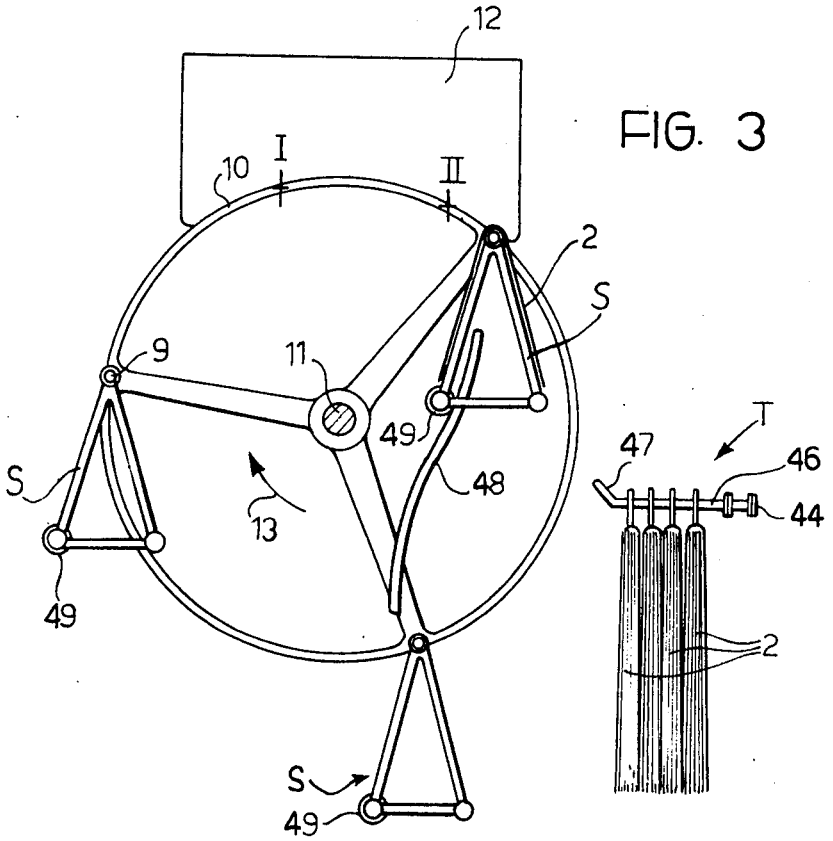
FIG. 3 is a detail of FIG. 2 which illustrates, on a larger scale, an intermediate transfer device forming part of the apparatus.

As shown in FIG. 3, the saddle S is one of a number of equi-spaccd saddles S pivoted by means of pins projecting sideways from its upper edge 9 to the rims 10 of a rotary member formed by a pair of spaced wheels which are keyed onto a shaft 11 which is parallel to the axis of the sprocket wheels 6 (and to the pivot axes of the saddles S). The intermediate transfer devices D, each of which is associated with one of the feeders, are also associated with and to some extent form part of stitching means 12 for forming spaced pairs of holes in the spines of the signatures 2 on the movable saddles, and for introducing into the inside of the signature through one hole of each pair and making reappear to the exterior through the other hole of the pair, a length of thermoplastic filament, for example made of nylon such that part of the filament extends between the two holes of the pair on the inside of the signature and the end portions of the filaments extend out through the holes in the exterior of the signature.

Figure 2:
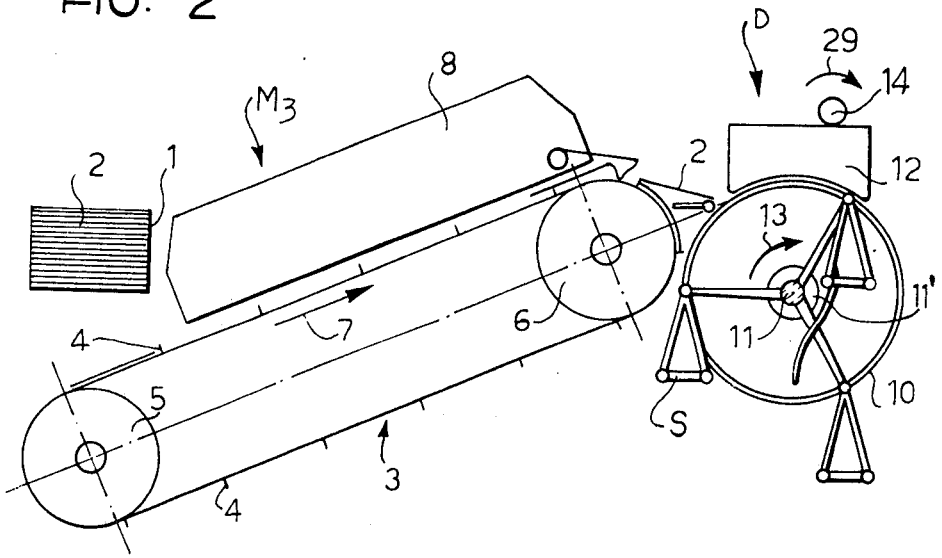
FIG. 2 is a schematic section taken along the line II—II of FIG. 1.
Figure 4:
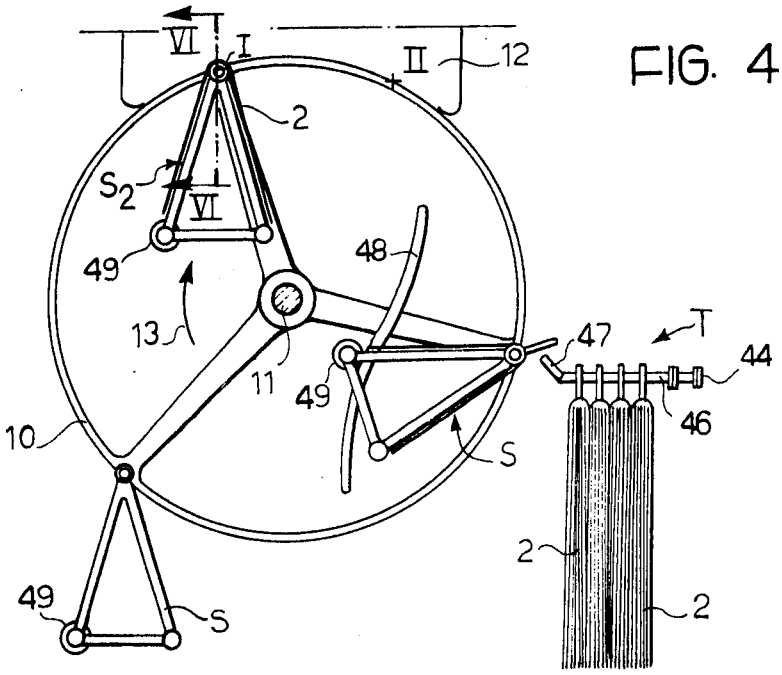
FIGS. 4 and 5 are similar views to that of FIG. 3 but show the intermediate transfer device in two different operative positions.
Figure 5:
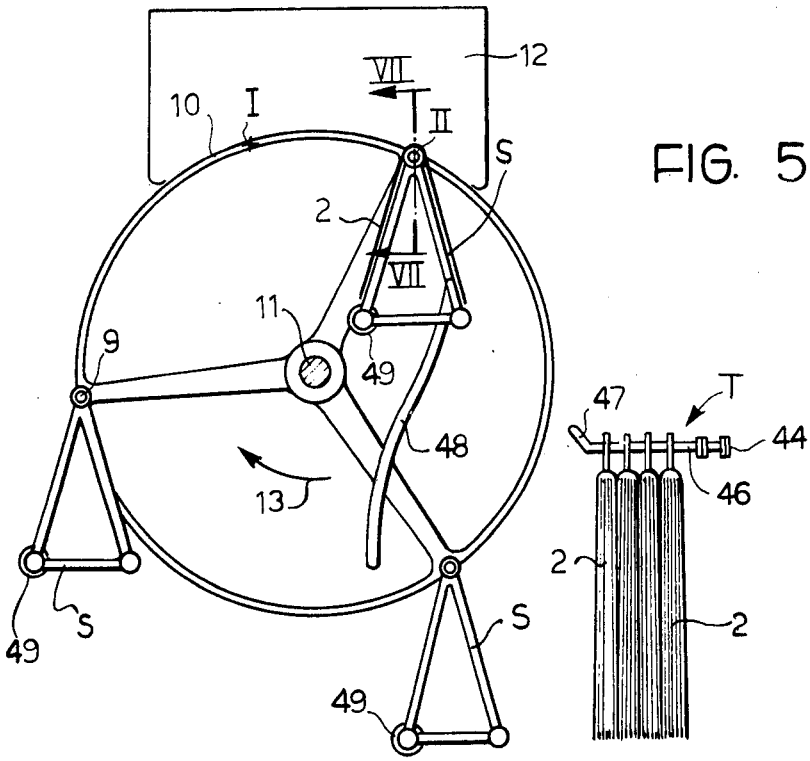

The shaft 11, and therewith the rotary member carrying the saddles S, is driven by conventional drive means 11' so that it rotates intermittently in the direction indicated by the arrow 13 in FIGS. 2 and 3, in syncrhonism with the operation of the respective feeder. Each saddle stops at the spaced positions I and II (see FIGS. 3 to 5) for a period required, respectively, for forming the holes and to pass through each pair of holes so formed a length of thermoplastic material filament unwound from a bobbin 14 (see FIGS. 1 and 2).

Figure 6:
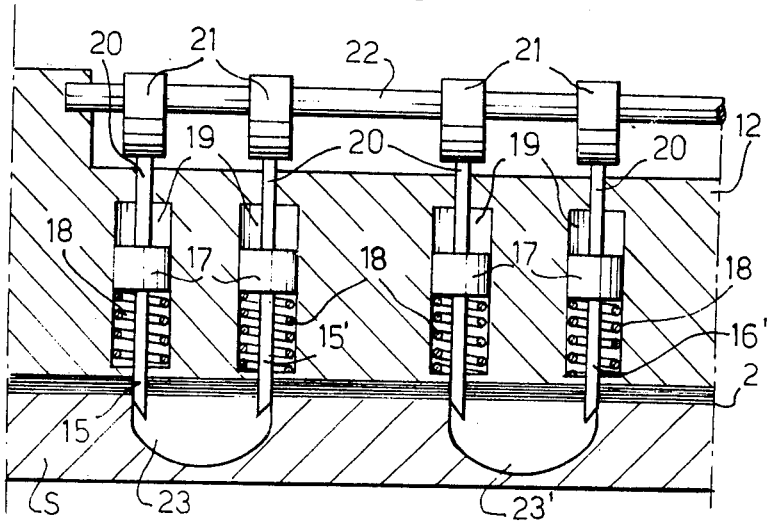
FIGS. 6 and 7 are schematic vertical sections along the lines VI-VI and VII—VII of FIGS. 4 and 5, respectively, on a larger scale.

The holes are formed by means of the mechanism illustrated in FIG. 6. It comprises pairs of punches, respectively 15, 15'; 16, 16', etc., spaced along the spine of the signature 2, carried by small pistons 17 which slide against the action of springs 18 within hollow cylinders 19 formed in the lower part of the stitching means 12. These pistons 17 have rods 20 which are actuated by cams 21 keyed to a cam shaft 22 which rotates in synchronism with the remainder of the apparatus in such a way that the punches 15, 15', 16, 16' etc. are thrust down when the saddle S has stopped in position I (see FIG. 4). When the pistons 17 reach their bottom dead center positions, the pointed ends of the punches 15, 15', 16, 16', etc. reach the end portions of respective U-shaped slots 23, 23', etc. formed in the top of the saddle S. The punches 15, 15', 16, 16', etc. spring back from the end portions of the slots 23, 23', etc., and form the spine of the signature 2 carried by the saddles S (see FIG. 6), after the rotation of the cam shaft 22 through a certain angle. The rotary member carrying the saddles is then rotated until the saddles reach position II. In this latter position (see FIGS. 5 and 7), lengths of filament 27 are inserted into the holes from formed by the punches 15, 15', 16, 16', etc., passing right through the body of the stitching means 12, the lengths of filament 27, 28, etc. being unwound from the bobbin 14.

Figure 7:
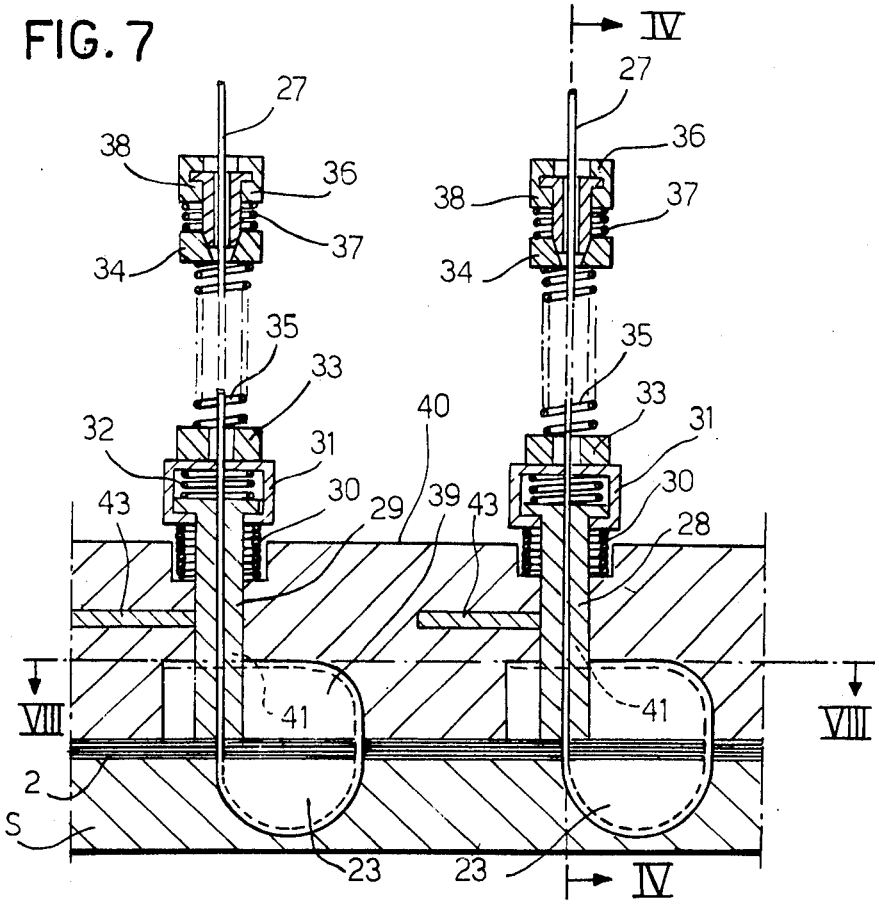
Figure 9:
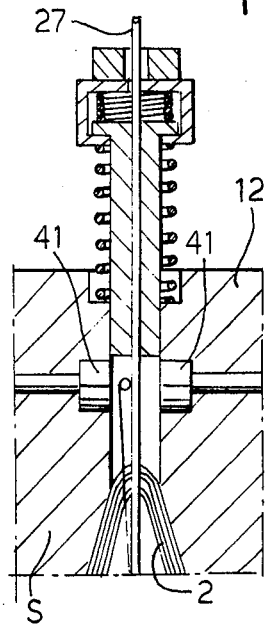
FIG. 9 is a vertical section along the line IX—IX of FIG. 7.
Figure 8:
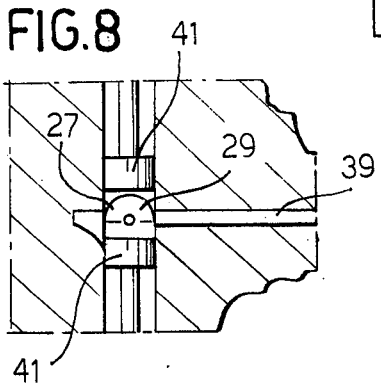
FIG. 8 is a horizontal section along the line VIII—-VIII of FIG. 7.
Figure 12:
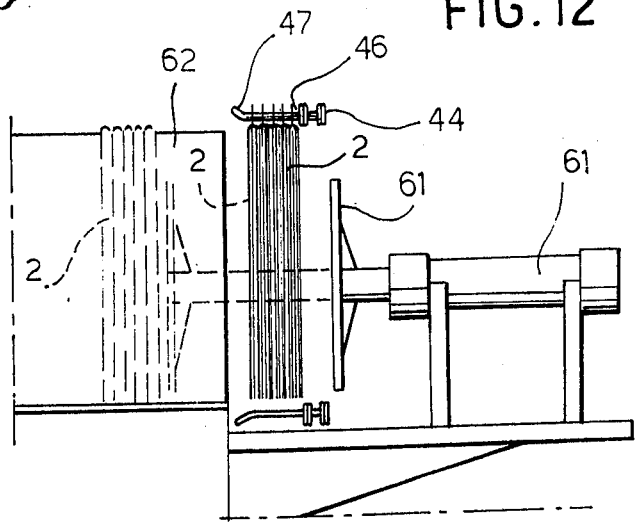
FIG. 12 is a schematic vertical section along the line XII—XII of FIG. 1, on a large scale.

Any suitable mechanism can be used for inserting the lengths of filament 27, 28, but one mechanism is shown by way of example in FIGS. 7 to 9.

The mechanism includes a sliding guide tube 29 which is sprung upwards by a spring 30 and which is shown in its lowermost position in FIG. 7 and in its uppermost position in FIG. 9. The guide tube 29 carries a head 31 sprung by a spring 32 to permit some sprung lost-motion in the mechanism, and the guide tube is actuated by a rocker 33 which in turn is actuated by a cam (not shown) in a conventional manner. As shown in FIG. 7, the guide tube 29 is depressed by the rocker 33 until its lower end abuts the signature 2 in registration with one of the holes made in the spine of the signature 2, thereby guiding the filament 27, 28, etc. straight through the hole. Above the rocker 33 is mounted a swinging arm 34 pivoted about a horizontal axis behind the plane of FIG. 7, the swinging arm 34 being sprung upwards by a spring 35 which is represented diagrammatically in FIG. 7 but in practice would be closely adjacent to the axis of the swinging arm 34. The swinging arm 34 is actuated by a rocker 36 which in turn is actuated by a conventional cam (not shown), the rocker 36 being sprung away from the swinging arm 34 by a spring 37 and carrying a number of jamming wedges 38. The spring 35 has effectively greater strength than the spring 37, but the upward motion of the swinging arm 34 is limited by a stop (not shown) so that in the at rest position, shown in FIG. 7, the rocker 36 is its maximum distance from the swinging arm 34 and the wedges 38 are retracted and do not jam the filament 27, 28, etc. However, when the rocker 36 is actuated to insert the filament 27, 28, etc., the spring 37 is compressed and the wedges jam the filament 27, 28, etc. with respect to the swinging arm 34 and the rocker 36, the filament thereby being advanced through a suitable distance. The rocker 36 is arranged to have a fast return so that the inertia of the swinging arm 34 causes it to remain substantially in its lowermost position until the jamming wedges 38 have been fully withdrawn, enabling the swinging arm 34 and rocker 36 to withdraw to their at rest positions without pulling out the filament 27, 28, etc.

The lengths of filament 27, 28, etc. are inserted into the U-shaped slots 23, 24, etc. formed in the top of the saddle S and surface at the exterior of the signature 2, passing through the holes formed by the punches 15, 15', 16, 16', etc. After surfacing, the lengths of filament are guided by the shaped upper walls of slots 39, 40, etc., which are open towards the bottom, until they cross over themselves and reach the position shown in dotted lines in FIG. 7. As shown in FIG. 8, one side of the lower end portion of the guide tube 29 is cut away and the slots 39, 40, etc. are oriented to avoid the leading end of the filament 27, 28, etc. fouling the other part of the filament where they cross over themselves. At a suitable moment (for instance after the withdrawal of the guide tube 29 in the mechanisms described above), electrically-heated plates 41, whose movement is actuated by any suitable mechanism (not shown), squeeze the crossed parts of the filament one against the other and weld them to each other, thereby forming a closed loop. At the same time as the welding, blades 43 (see FIG. 7) are actuated by any suitable mechanism (not shown), separating the formed loops from the respective bobbins 14.

The rotary member of the intermediate transfer device D then recommences its rotation and the signature 2 is transferred (see FIG. 3) to the conveyor T.

This latter consists of a continuous chain 44 supported and guided by small sprocket wheels 45, two of which are shown in FIG. 1. This chain 44 is driven by at least one sprocket wheel (not shown) whose rotation is synchronized with the movement of the remainder of the apparatus. Groups of bars 46 (see FIG. 3) are fixed to the chain 35 at intervals, the bars being formed with tips 47 which are bent in such a manner as to be inclined upwards when on the upper run of the chain 44. The bars 46 are positioned such that each group of bars 46 can receive the loops anchored to the spine of a signature 2 which is transferred from one of the feeders, and such that when the bars 46 of one of the groups are in such a position as to receive the loops of the signature 2 coming from one of the feeders, other groups of bars 46 are in respective positions for receiving the signatures 2 coming from the other feeders. The chain 44 effects the intermittent movements which are necessary to move the groups of bars 46 which have received the signature coming from one feeder, to the position in which such bars are ready to receive the signature 2 coming from the next feeder, the periods of advance of the chain 44 being interrupted by dwell periods necessary for the engagement of the loops anchored to the signatures with the bars 46 of the respective group.

In order to make such engagement possible, each saddle is made to tilt with respect to its vertical position, during its passage from position II to the position indicated in FIG. 3, by the action of fixed cams 48 cooperating with little rollers 49 carried by the saddle, such that the loops swing out towards and engage over the bent tips 47 of the bars 46; this tilting movement of the saddle also facilitates the disengagement of the signature 2 from the saddle S during the following downwards and rearwards movement of the saddle S.

In this manner, the signatures 2 coming from the successive feeders $M_1$, $M_2$, $M_3$ are hung one after the other on the bars 46 of each group, the arrangement acting as a gathering means and bringing adjacent one another the group of signatures 2 for one book, in a predetermined order, and also somewhat tensioning the parts of the filaments 27, 28, etc. on the insides of the signature.

Figure 11:
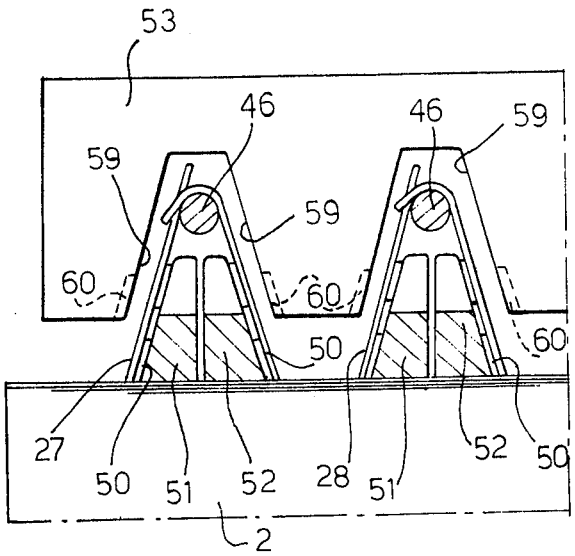
FIG. 11 is a vertical section along the line XI—XI of FIG. 10.
Figure 10:
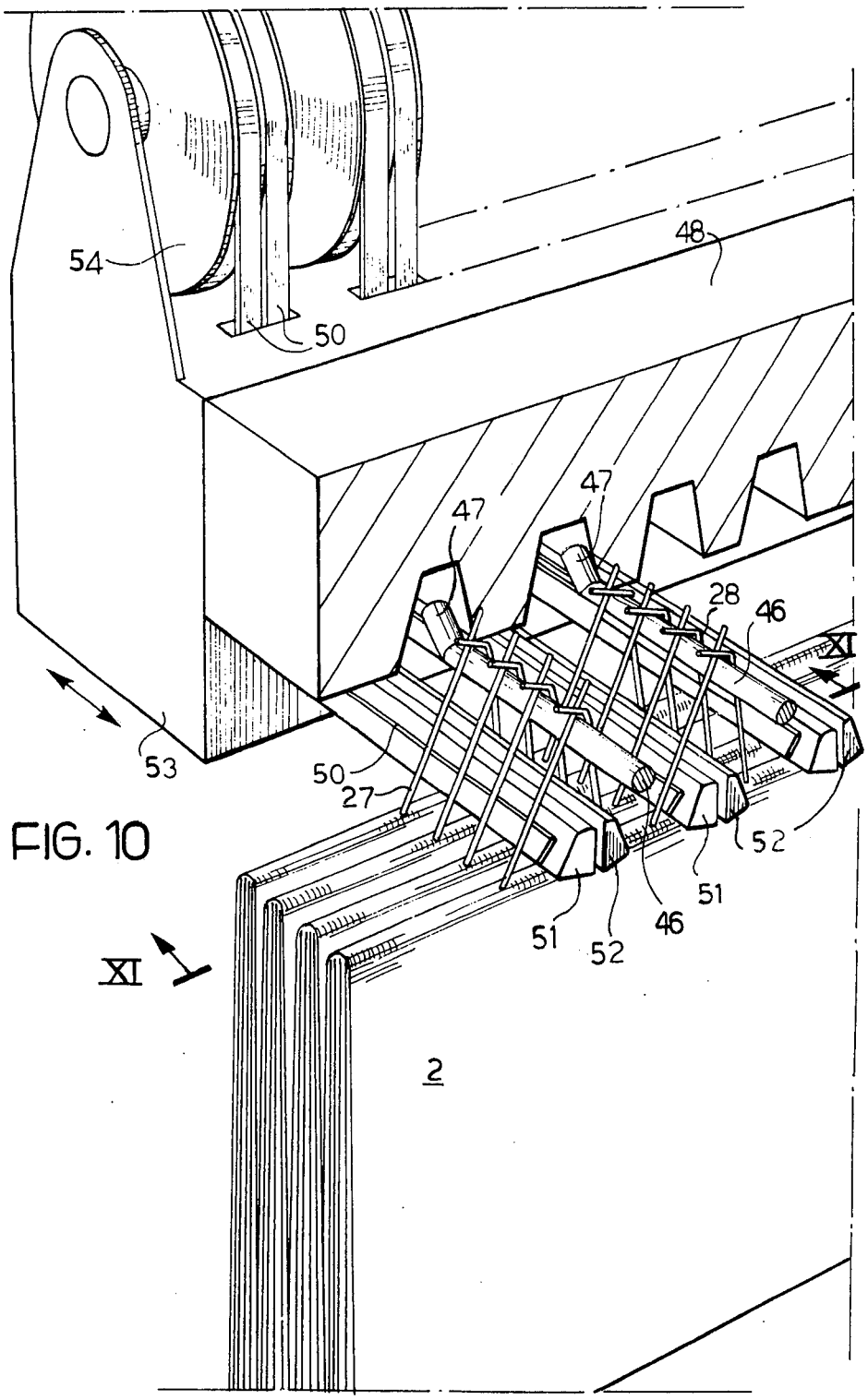
FIG. 10 is a perspective view of part of welding means forming part of the apparatus, on a larger scale than FIG. 1.

After the next intermittent advance of the main conveyor T, the already formed group of signatures 2, hung from one group of bars 46, stops in front of the welding means H. During the dwell period at the welding means H, lengths of thermoplastic tapes or strips 50 (see FIGS. 10 and 11), for example made of nylon, are inserted within the loops anchored to the signatures 2 by inserting into the loops pairs of support members in the form of shaped bars 51 and 52 carried by a mobile head 53 which is displacable in the direction of the double arrow shown in FIG. 10. The tapes or strips 50 are unwound from spools 54. Following this, the bars 51 and 52 can if desired be lowered and spread apart slightly using any suitable mechanism (not shown) to press down on the spines of the signatures 2 and tension the loops while bringing the tapes or strips 50 into contact with the spines. Subsequently at least the top portions of the groups of signatures 2 are pressed by a plate 55 (see FIG. 1) having an actuator 56 against a pedestal 57 of the welding means H, thereby pressing the spines of the signatures 2 together. Thereafter a bracket 58 is lowered, the bracket 58 being provided with transverse cut-outs in whose opposite inclined faces 59 are inserted electrical heating elements 60 suitable for welding the filaments 27, 28, etc. to the tapes or strips 50 to join the signatures 2 together. At this moment, it is desirable to have the filaments 27, 28, etc. under slight tensio so that when they become heated and soften, any inequalities in tension in the filaments 27, 28, etc. along the lengths of the spines of the signatures 2 or among the various signatures 2 are substantially eliminated. The operation terminates with raising the bracket 58, cutting the end portions of the tapes or strips 50 off from the remainder by any suitable cutting mechanism (not shown), retracting the head 53 to extract the bars 51 and 52 from the loops anchored to the signatures 2, and advancing further lengths of tape or strip 50 along the bars 51 and 52 by any suitable mechanism (not shown), for instance by rotating the bobbing 54 a predetermined distance in the unwind direction.

The main conveyor T is now advanced to move the groups of bars 46 to the discharging means E (see FIG. 1), at which the book is disengaged from the bars 46 by the action of a pusher 61 having an actuator 62 which pusher pushes the preformed book into a guide 63 (see FIG. 1) from which the preformed books can be unloaded by hand or can be passed to a mechanical conveyor. Further operations such as cutting off those parts of the filaments 27, 28, etc. which project above the tapes 50 and applying the cover can then be carried out.

Naturally, while maintaining the principle of the discovery, its details can be widely varied with respect to what has been described above and illustrated solely by way of example, without departing from the scope of the present invention.

Thus, for example, the feeders can be of any other suitable type, and the supports for the signatures carried by the main conveyor can be made of boxes which are open upwards and towards the intermediate transfer devices, and the signatures can be transferred from the mobile saddles to such containers by suitable gripper arms or suckers. In such a case, it would not be necessary that the lengths of filaments inserted in the pairs of holes formed in the spines of the signatures should form closed loops. In fact, it would be sufficient for short lengths of filaments passing through the pairs of holes formed in the spines of the signatures merely to project outwardly from such holes.

The containers could be hung from the chain 35 or mounted on carriages which are moved intermittently along a continuous path, one of the runs of which would be close to the exits from the intermediate transfer devices associated with the various feeders. The movements of the various moving parts of the apparatus could be effected by the engagement of gear transmissions, lever transmissions, flexible cables, or by the operation of hydraulic, pneumatic or electrical actuators.

Further, the intermediate transfer device D and the main conveyor T could be continuously movable. In such a case, it would be sufficient for the stitching means 12 to have a reciprocal movement so as to advance together with the saddles carrying the already opened signatures and to return, and for the signatures with the filaments already inserted in the respective spines to be transferred onto intermediate supports arranged to accompany the continuous movement of the conveyor for the time necessary to transfer such signatures from the intermediate supports and arranged then to return to their initial position, rather than transferring the signatures directly to the main conveyor T. The head 53 carrying the shaped bars 51 and 52 could be stationary (i.e. not movable in the direction of the double arrow shown in FIG. 10, and the books carried by the bars 46 of the main conveyor could instead be movable towards the head 53, which bars 46 could, if necessary, be movable towards the head 53 under the action of cams.

Though it is preferred that the filaments 27, 28, etc. and the tapes or strips (transverse members) 50 be wholly of thermoplastic material, this is not essential as the filaments and/or transverse members may for instance have a non-thermoplastic structure e.g. of textile fibers which is impregnated with a thermoplastic material.

1. A process for the manufacture of sewn books from a plurality of signatures, comprising: forming spaced holes in the spine of each signature, inserting through pairs of said holes a length of at least partly thermoplastic filament such that part of the filament extends between two such holes on the inside of the signature and portions of the filament extend out through the holes to the exterior of the signature, placing a plurality of such signatures in close relationship, and welding the respective exterior parts of the filaments of the signatures to respective transverse at least partly thermoplastic members, thereby joining the signatures together.

2. The process of claim 1, comprising welding one end portion of each length of filament to the other end portion thereof to form a closed loop and subsequently supporting the respective signatures by means of the closed loops while placing the signatures in close relationship.

3. The process of claim 1, comprising welding one end portion of each length of filament to the other end portion thereof to form a closed loop, and subsequently tensioning the filaments prior to welding the respective exterior parts of the filaments to the transverse member by applying tension to the closed loops.

4. A process for the manufacture of sewn books from a plurality of signatures, comprising: forming spaced holes in the spine of each signature, inserting through pairs of said holes a length of at least partly thermoplastic filament such that part of the filament extends between two such holes on the inside of the signature and portions of the filament extend out through the holes to the exterior of the signature, welding one end portion of each length of filament to the other end portion thereof to form a closed loop, placing a plurality of such signatures in close relationship while supporting them by the closed loops, and interconnecting the respective exterior parts of the filaments of a plurality of such signatures by welding, thereby joining the signatures together.

5. Apparatus for manufacturing sewn books from a plurality of signatures, the apparatus comprising:

stitching means for forming spaced holes in the spine of each signature and for inserting the leading end of a length of at least partly thermoplastic filament through one said hole and out through another said hole, whereby part of the filament extends between two such holes on the inside of the signature and the end portions of the filament extend out through the holes to the exterior of the signature;

gathering means for placing the plurality of such signatures in close relationship;

means for bringing respective transverse at least partly thermoplastic members adjacent to the exteriors parts of the filaments; and welding means for welding the respective exterior parts of the filaments to the transverse members, thereby joining the signatures together.

6. Apparatus as claimed in claim 5, and comprising welding means for welding one end portion of each length of filament to the other end portion thereof after the filament has been inserted through the holes in the spine of the signature, to form a closed loop, the gathering means including at least one projecting member for entering the loop and supporting the respective signature while placing the signatures in close relationship.

7. Apparatus as claimed in claim 5, and comprising at least one saddle for receiving signatures open at the middle, intermittently movable drive means for driving the saddle and stopping the saddle at two spaced positions for cooperating with the stitching means, namely at a first position for the formation of the holes and at a second position for the insertion of the length of filament, and a conveyor for receiving the signatures from the saddle and conveying the signatures to the welding means.

8. Apparatus for manufacturing sewn books from a plurality of signatures, the apparatus comprising:

stitching means for forming spaced holes in the spine of each signature and for inserting the leading end of a length of at least partly thermoplastic filament through one said hole and out through another said hole, whereby part of the filament extends between two such holes on the inside of the signature and the end portions of the filament extend out through the holes to the exterior of the signature;

welding means for welding one end portion of each length of filament to the other end portion thereof after the filament has been inserted through the holes in the spine of the signature, to form a closed loop, gathering means for placing a plurality of such signatures in close relationship, the gathering means including at least one projecting member for entering the loop and supporting the respective signature while placing the signatures in close relationship; and welding means for interconnecting by welding the respective exterior parts of the filaments of the individual signatures, thereby joining the signatures together while supported by the projecting member.

9. Apparatus as claimed in claim 8, and comprising a plurality of feeders for opening signatures at the middle and a conveyor for receiving signatures coming from the successive feeders, the conveyor being comprised of gathering means and a plurality of said projecting members being mounted on and forming part of the conveyor, whereby the conveyor gathers together all the signatures which are to be joined together.

10. Apparatus as claimed in claim 8, wherein the stitching means comprise a support for the inside of the spine of the signature, which support defines at least one generally U-shaped elongated slot in its top surface positioned so that the respective ends of the slot substantially register with respective said holes in the spine of the signature, and filament inserting means for inserting the leading end of the filament through one hole under axial pressure, whereby the leading end of the filament is guided in a curved path by the base of the slot and exits through the other hole in the spine of the signature.

* * * * *